US006681607B2

(12) United States Patent
Geringer

(10) Patent No.: US 6,681,607 B2
(45) **Date of Patent: *Jan. 27, 2004**

(54) LOCK WITH SENSOR

(75) Inventor: Arthur Geringer, Westlake Village, CA (US)

(73) Assignee: Security Door Controls, Inc., Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/001,129

(22) Filed: Oct. 23, 2001

(65) Prior Publication Data

US 2002/0116969 A1 Aug. 29, 2002

Related U.S. Application Data

(63) Continuation of application No. 09/354,856, filed on Jul. 29, 1999, now Pat. No. 6,363,763.

(51) Int. Cl.[7] ..... E05B 41/00

(52) U.S. Cl. ..... 70/432; 70/434; 70/DIG. 30; 70/DIG. 59

(58) Field of Search ..... 70/432–434, DIG. 30, 70/DIG. 59

(56) References Cited

U.S. PATENT DOCUMENTS 6,363,763 B1 * 4/2002 Geringer et al. ..... 70/432

* cited by examiner

*Primary Examiner*—Suzanne Dino Barrett
(74) *Attorney, Agent, or Firm*—Koppel, Jacobs, Patrick & Heybl

(57) ABSTRACT

A lock with sensor comprises a housing defining a chamber and a latch mechanism located within the chamber of the housing. The latch mechanism is movable relative to the housing between a retracted position wherein the latch mechanism is substantially within the housing and an extended position wherein the latch mechanism extends at least partially outside of the housing. A sensor mechanism is provided and has a fixed switch portion located within the chamber and a movable switch activator portion, the switch activator portion being mounted so as to move with the latch mechanism and thereby activate and deactivate the switch portion respectively.

26 Claims, 5 Drawing Sheets

FIG. 1
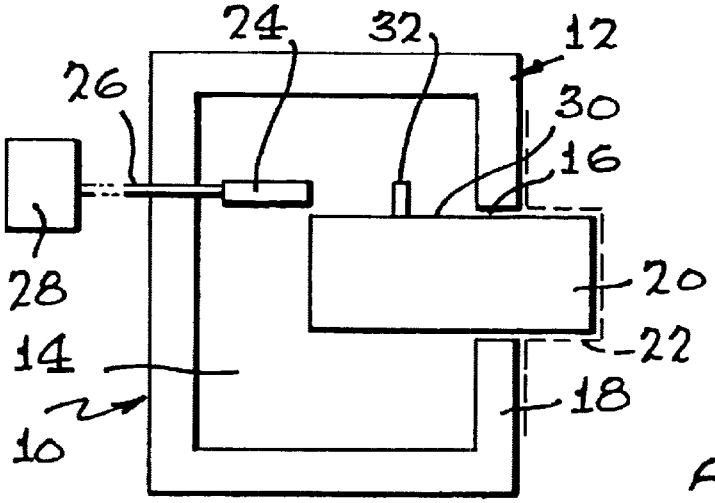
FIG. 2
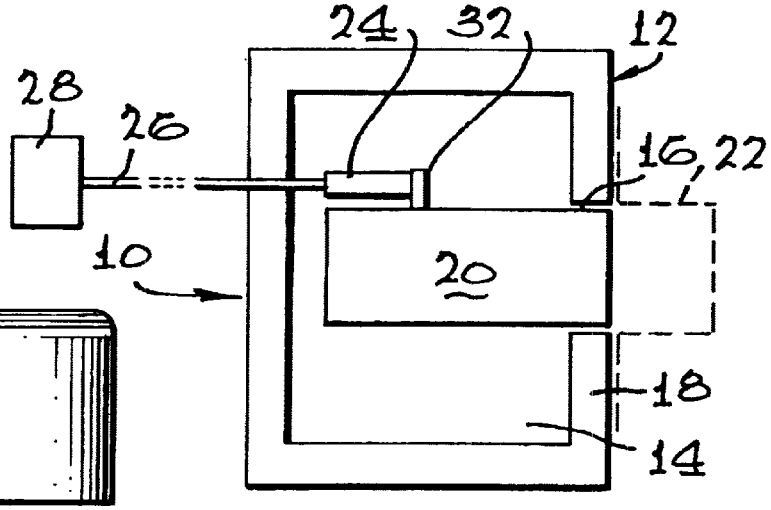
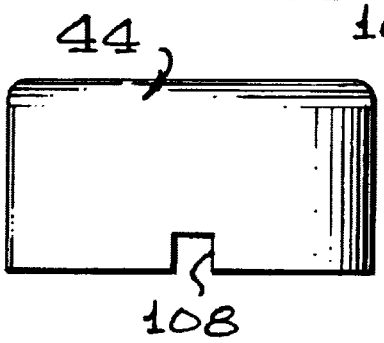
FIG. 11
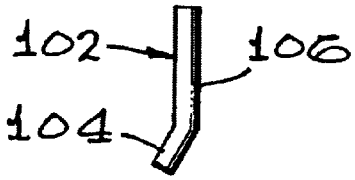
FIG. 10
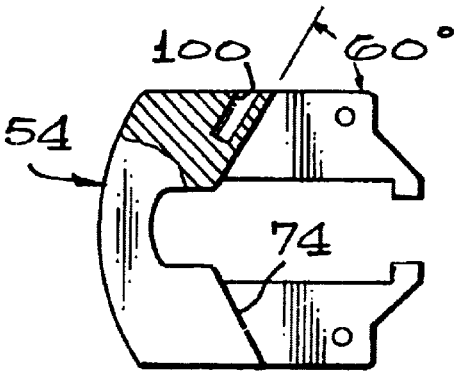
FIG. 9

FIG. 4a
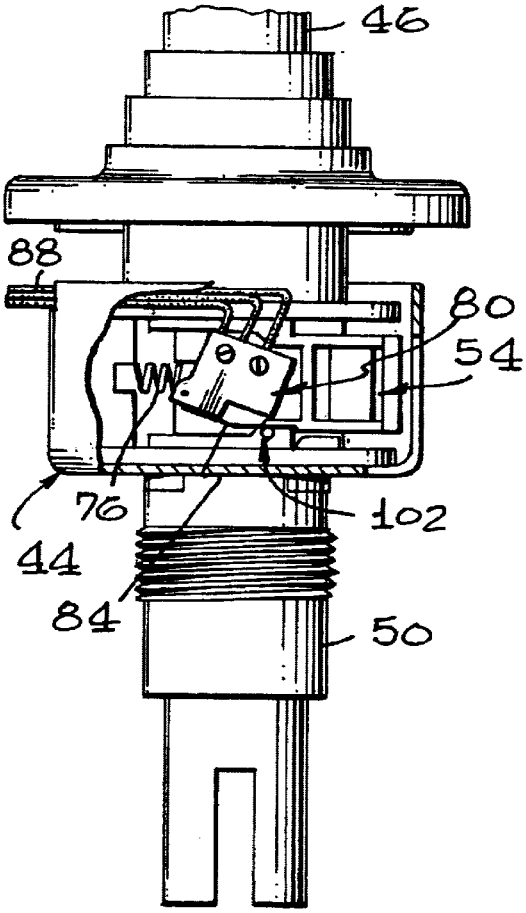
FIG. 5a
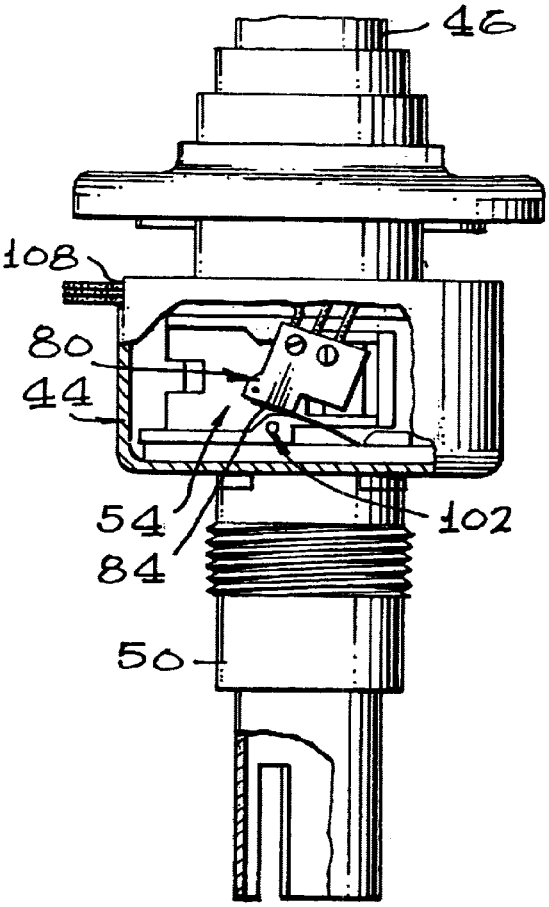
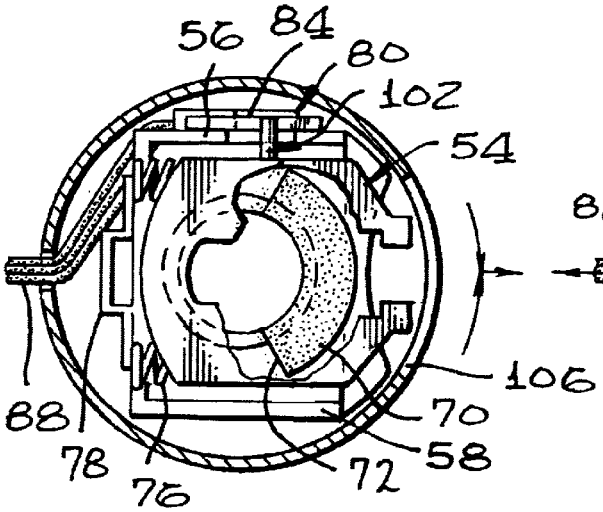
FIG. 4b
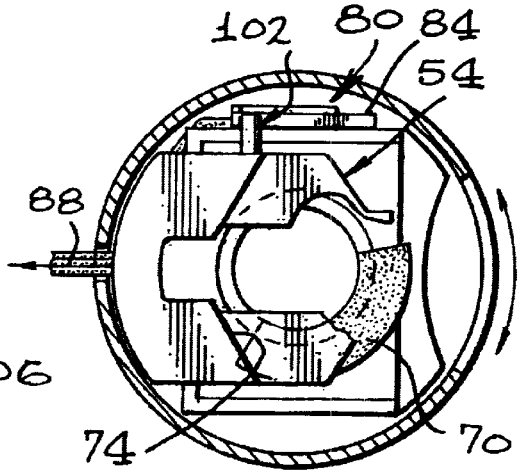
FIG. 5b

LOCK WITH SENSOR

This is a Continuation of Application No. 09/354,856 filed Jul. 29, 1999, now U.S. Pat. No. 6,363,763.

FIELD AND BACKGROUND OF THE INVENTION

This invention relates to locks with sensors, and particularly a lock incorporating sensing and/or switching equipment therein in order to provide signals to an external source relating to the condition of the lock.

Locks are, of course, well known and are available in many different forms and configurations. For the most part, however, locks comprise some form of housing which accommodates a reciprocating latch or lever, the latch being movable between an unlocked withdrawn position and a locked extended position. In the withdrawn position, the latch would normally be contained within the housing, while in the extended position, the latch would engage an external and adjacent object to effect the locking operation. The latch would normally be movable between the withdrawn and extended position in response to the rotation of a key in the lock, or rotation of a handle, although such movements may also be in response to electrical, magnetic, pneumatic or other types of mechanical activation.

It is also known to provide external sensors with respect to such locks. Conventionally, a sensing switch or other device may be located externally of the lock, in order to sense or determine the position of the lever. The mechanical movement of the lever into the extended position has the effect of activating the sensor in one way to provide signals as to its condition, while the sensor would be activated in another manner to indicate the withdrawn or unlocked position of the lever.

It may be important to determine the position of the latch, namely, whether in the extended or retracted position, so that devices or systems can be connected to the lock and react according to the position of the latch. For example, the lock may be connected to an alarm system, such that when the lock is moved from the locked to an unlocked position while the alarm is operational, a signal will be provided to trigger the alarm. The lock may also be connected to video and/or audio recording equipment, heating and cooling systems, lighting systems, computers and/or other recording instruments to collect information on personnel or objects entering or leaving a particular area, especially areas which contain information or products which may be of a classified or confidential nature.

SUMMARY OF THE INVENTION

According to one aspect of the invention, there is provided a lock with sensor comprising: a housing defining a chamber; a latch retractor located within the chamber of the housing and being movable relative thereto between a retracted position wherein the latch retractor is substantially within the housing and an extended position wherein the latch retractor extends at least partially outside of the housing; and a sensor mechanism having a fixed switch portion located within the chamber and a movable switch activator portion, the switch activator portion being mounted so as to move with the latch retractor and thereby activate and deactivate the switch portion respectively.

According to another aspect of the invention, there is provided a m of detecting the position of a latch retractor within a housing of a lock, the latch retractor being movable between a retracted position and an extended position, the method comprising: mounting a switch member at a fixed location within the housing of the lock; mounting a switch actuator member on the latch mechanism within the housing, wherein the switch actuator member operatively engages and activates the switch member in one of the retracted or extended positions, and is remote from the switch; and transmitting signals from the switch member, according to the position of the latch mechanism, to an external source component remote from the lock.

The invention provides a lock incorporating a sensing mechanism for detecting the locked or unlocked condition thereof. Preferably, the lock comprises a housing member with a movable latch or lever therein, the latch being movable between an unlocked withdrawn position and a locked extended position, the movement of the latch causing activation or deactivation of a switch member. Preferably, the switch member, upon detecting a change in the condition of the lock, provides a signal to an external component, the component functioning in a predetermined manner according to the condition of the lock.

Preferably, the sensing mechanism contained within the lock comprises a fixed member within the housing, and a movable member which moves with the lever between the extended and the retracted position, such that the orientation of the movable member in relation to the fixed member is able to provide the appropriate signal as to the condition of the lock. The fixed member is conveniently an electric switch, which sends an electric signal to the external component. The movable member may comprise a pin, magnet, projection on the lever, or other physical means which, by virtue of its movement with the lever between the extended and retracted position, has the effect of activating or deactivating the switch.

The activation of the switch may cause different results at the external component, depending upon the nature of the external component. For example, when the latch is in the withdrawn position, it may switch off the external component, which may be a surveillance camera; on the other hand, it may switch on the external component, which may be a light. Thus, the movement of the latch and the movable means will have the effect of activating or deactivating the switch, with either one of these conditions being used by the external component according to the type of function it performs. In other words, the component, depending on its nature, may be switched either on or off when the latch is in the withdrawn position. The lock with sensor of the invention would be used appropriately to activate or deactivate the component, as appropriate, when the latch is withdrawn.

The invention has particular application with respect to cylindrical locks, including those using pin tumblers which need to be properly aligned with respect to each other by a key in order to rotate the cylinder. However, the invention is not restricted to such locks, and can be used with any lock mechanism which includes a fixed housing and a movable lever therein.

DESCRIPTION OF THE DRAWINGS

FIG. 1 is a schematic representation of a lock with sensor of the invention, with the lever in the extended position;

FIG. 2 is a schematic representation of the lock with sensor of the invention as shown in FIG. 1, with the lever in the retracted position;

FIG. 4(*a*) is a top view of the lock with sensor as shown in FIG. 3, partially in section, with the lever in the extended position;

FIG. 4(*b*) is a side view of the lock with sensor as shown in FIG. 3, partially in section, with the lever in the extended position;

FIG. 5(*a*) is a top view of the lock with sensor as shown in FIG. 3, partially in section, with the lever in the retracted position;

FIG. 5(*b*) is a side view of the lock with sensor as shown in FIG. 3, partially in section, with the lever in the retracted position;

FIG. 7(*b*) is a side view of the lock with sensor as shown in FIG. 6, partially in section, with the lever in the extended position;

FIG. 8(*b*) is a side view of the lock with sensor as shown in FIG. 6, partially in section, with the lever in the retracted position;

FIG. 9 is a side view, partially in section, of the latch mechanism showing the pin hole;

FIG. 10 is a side view of the pin member; and

FIG. 11 is a top view of the housing showing the slot for the wire.

DETAILED DESCRIPTION OF THE PREFERRED EMBODIMENTS

Figure 3:
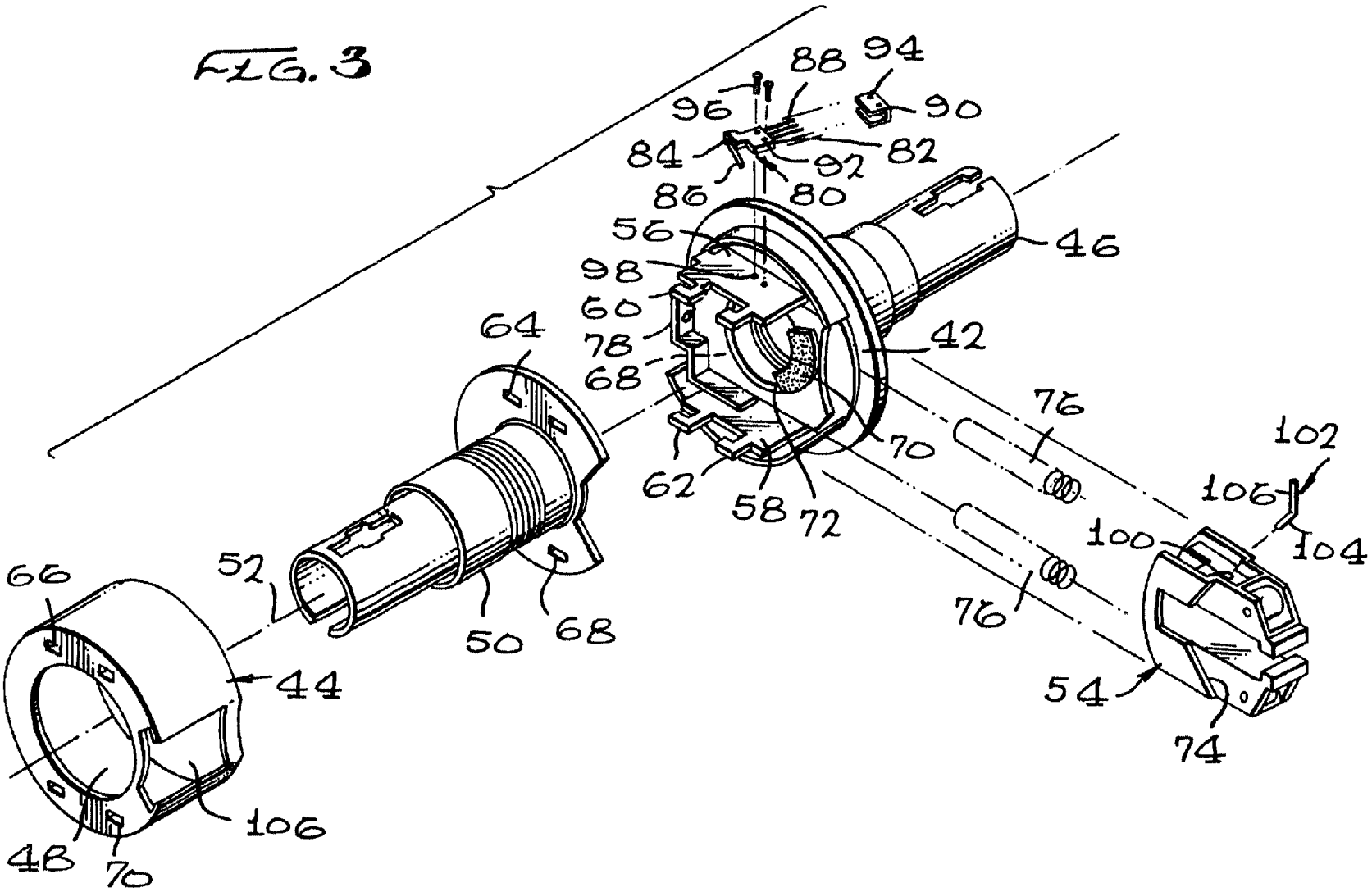
FIG. 3 is an exploded perspective view of a first embodiment of a lock of the invention.

With reference to the drawings, there is shown schematically, as well as in various detailed embodiments, the lock with sensor of the invention. With reference to FIGS. 1 and 2, there is shown in schematic form the essential features which comprise the invention. These Figures show a lock with sensor 10 comprising a housing 12 which defines a space or chamber 14. The housing 12 has an opening 16 in a side wall 18. Within the chamber 14, there is located a latch 20 which is slidable within the housing 12 between an extended position, as shown in FIG. 1 of the drawings, and a retracted position, as shown in FIG. 2. The lock with sensor 10 would typically be mounted to a door or the like, and align with another object, such as an adjacent door or jamb. The latch 20, when in the extended position, enters a catch or groove 22, in conventional fashion.

The lock with sensor includes a switch mechanism 24 mounted within the chamber 14, and in fixed position within the housing. The switch has wiring 26 extending therefrom to a source component 28, the source component 28 in the drawings being representative of any one of a number of devices, such as a camera, an alarm, lighting system, computer, or the like. The scope of the invention is not limited by the nature of the source component 20 or the function which it is to perform. Rather, the invention is intended to provide an electric or other signal from the switch 24 to any predetermined source component 28 to be used in the desired manner.

On the upper surface 30 of the latch 20, there is located a pin 32 which is fixed to the latch 20. The pin 32 reciprocates within the chamber 14 as the latch 20 moves between its extended and retracted positions. This is clearly illustrated in FIGS. 1 and 2 of the drawings. When the latch 20 is in the extended position, the pin 32 is remote from the switch 24. On the other hand, when the latch 20 is withdrawn into its retracted position, the pin 32 comes into contact with the switch 24, closing the electrical circuit in a conventional manner and changing the nature of the signal transmitted through the wiring 26 to the resource component 28. The reciprocation of the pin 32 therefore has the effect of turning on or off, as desired, the source component 28.

Reference is now made to FIGS. 3 to 5 of the drawings, which show the specific features of the invention in a more detailed embodiment of the invention. With reference to these Figures, there is shown a lock with sensor 40 comprising a housing base 42 which is releasably attached to a housing 44, as will described in further detail below. Extending from the housing base 42 is a fixed handle 46, and on the opposite side of the lock with sensor 40, and extending outwardly through an aperture 48 in the housing 44, is a removable handle 50. In conventional fashion, the handles 46 and 50 can be rotated about their longitudinal axes, represented by line 52, to move a latch retractor 54 between an extended and retracted position, to be described in further detail below. The rotation of the handles 46 and 50 may only be possible upon insertion of a key (not shown) within the lock, or by first using a key to allow rotation of the handles 46 and 50. Various permutations as to the ability of these handles 46 and 50 to rotate may be possible, and the invention is not limited to any one configuration.

Attached to the housing base 42 there is located an upper internal bracket 56 and a lower internal bracket 58, which are essentially parallel to each other. Each of the internal brackets 56 and 58 has a pair of jaws 60 and 62 respectively. The jaws 60 pass through the upper slots 64 of the handle 50, and thereafter engage the upper slots 66 of the housing 44. The jaws 62 pass through the lower slots 68 of the handle 50, and engage the lower slots 70 of the housing 44. In this way, the upper and lower internal brackets 56 and 58 are attached, releasably, to the handle 50 and housing 44.

The housing base 42 and housing 44, when connected as described above, define a chamber 68 in which the latch mechanism 54 and related components are contained.

Thee lock with sensor 40 further comprises a rotatable cylinder 70, rotation of which is in response to the rotating of either one of handles 46 or 50. Rotation of the cylinder 70 has the effect of moving the latch retractor from the extended to the retracted position. The cylinder 70 engages the latch mechanism 54, as best shown in FIGS. 4(*b*) and 5(*b*) of the drawings. In FIG. 4(*b*), the latch is in the extended position, but rotation of the cylinder 70 causes the cylinder 70 to move the latch 54 towards the retracted position. The rotational movement of the cylinder 70 is thus converted to a linear motion of the latch mechanism 54. The cylinder 70 has abutment edges 72 which engage with angled abutment edges 74 of the latch mechanism 54. The latch mechanism 54 is, under normal conditions, biased by springs 76 so that the latch member 54 is urged towards the extended position. When the cylinder 70 moves the latch retractor 54 against the action of the springs 76, it moves to its retracted position, and its extent of travel is limited by a rear abutment plate 78.

The upper internal bracket 56 is designed so as to receive and hold in a fixed position a switch 80. The switch 80 comprises a switch housing 82 and an element 84. The element 84 is comprised of a resilient material which can be moved so that its end 86 is either away from the switch housing 82 or in contact therewith. When the end 86 contacts the switch housing 82, the circuit is closed, and electrical signals can be transmitted along wires 88 to a source component. The source component is not shown in FIGS. 2 to 5, but may be any one of a number of devices, for example as discussed with respect to FIGS. 1 and 2.

The switch 80 is located within an insulator 90, the insulator 90 comprising a U-shaped bracket for receiving the switch 80. Both the switch 80 and insulator 90 have a pair of holes 92 and 94 through which screws 96 may pass. The upper internal bracket 56 has a pair of tapped holes 98, which are arranged with respect to each other such that the screws 96 pass through the insulator 90, switch 80, and are fixed to the upper surface of the internal bracket 56.

The latch retractor 54 has a pin hole 100 for receiving a pin 102. The pin hole 100 is angled with respect to the horizontal, as best illustrated in FIG. 9. In one preferred form, the pin hole 100 has an axis which is approximately at 60° to the horizontal. The pin 102 itself comprises a base portion 104 and a projecting portion 106. The base portion 104 is located in the pin hole 100, and the projecting portion 106 extends outwardly beyond the upper surface of the latch retractor 54.

As will be appreciated, the pin 102 moves with the latch retractor 54, so that it reciprocates between a first position when the latch retractor is extended, and a second position when the latch is retracted. This arrangement can be clearly seen by comparing FIGS. 4(*a*) and 5(*a*), and FIGS. 4(*b*) and 5(*b*). When the latch retractor 54 is in the extended position, the pin 102 moves the end 86 of element 84 so that it comes into contact with the remainder of the switch 80, closing the electric circuit. This is clearly seen in FIG. 4(*a*) of the drawings. On the other hand, when the latch retractor 54 is moved into the retracted position, the pin 102, and particularly the projecting portion 106 thereof, is moved away from the switch 80 such that the element 84, due to its resilience, moves away from the switch housing 82, leaving the electric circuit open. Thus, the position of the latch will determine the presence or absence of an electrical signal transmission through the wires 88, which can be used at the source component in the desired manner.

In order to permit the latch retractor 54 to move into the extended position, and project partially to the outside of the housing 44, the housing 44 includes an opening 106. The housing 44 will also include appropriate apertures, for example aperture 108, through which the wires 88 extend from the chamber 68 to the outside of the lock with sensor 40, for appropriate connection to the source component and such other devices, such as a power source, necessary to make it operational. In FIG. 11 of the drawings, the housing 44 is shown in top view, and the aperture 108, through which the wires can be threaded from the outside into chamber, is clearly illustrated.

Figure 6:
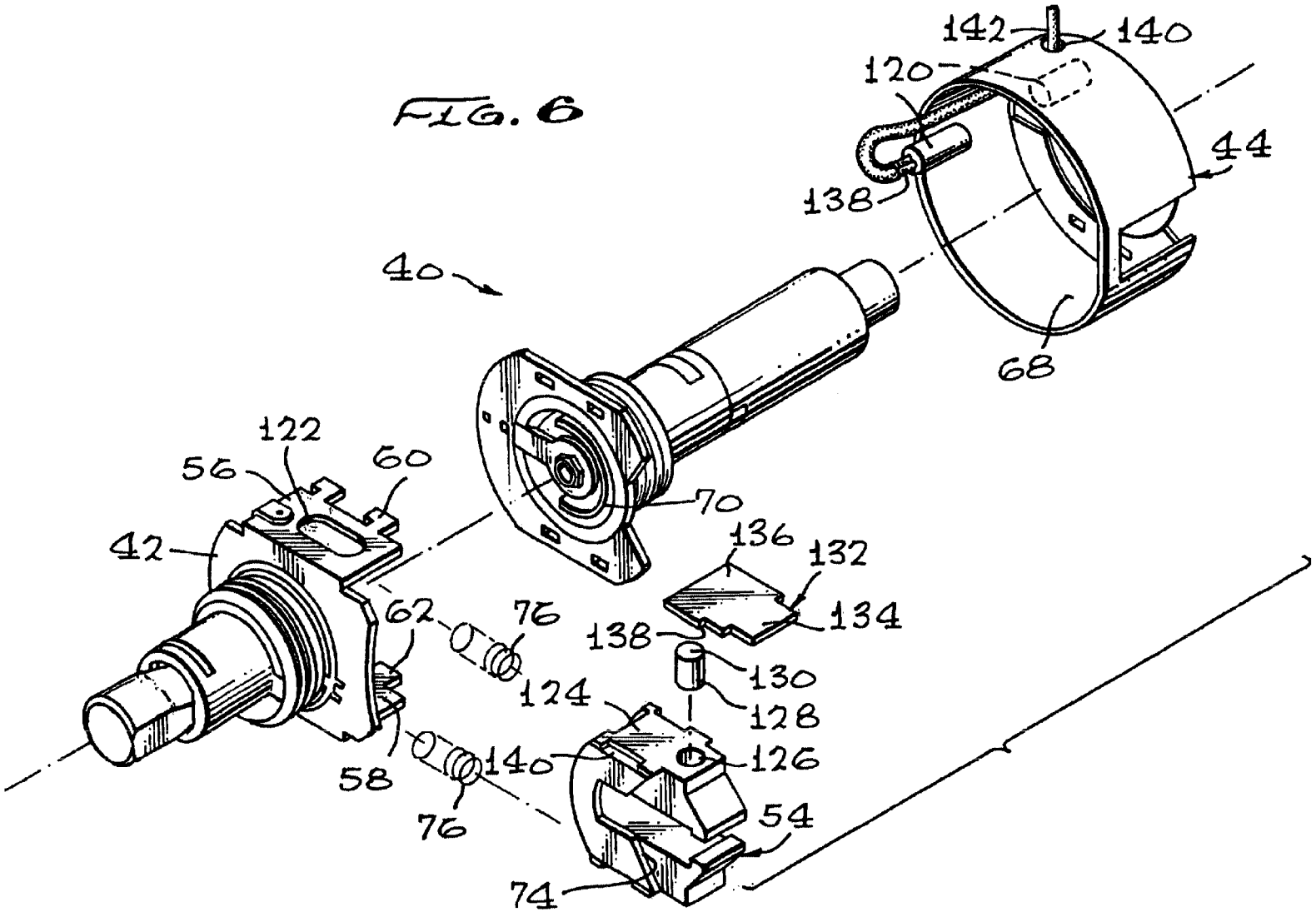
FIG. 6 is an exploded perspective view of a second embodiment of a lock of the invention.
Figure 7A:
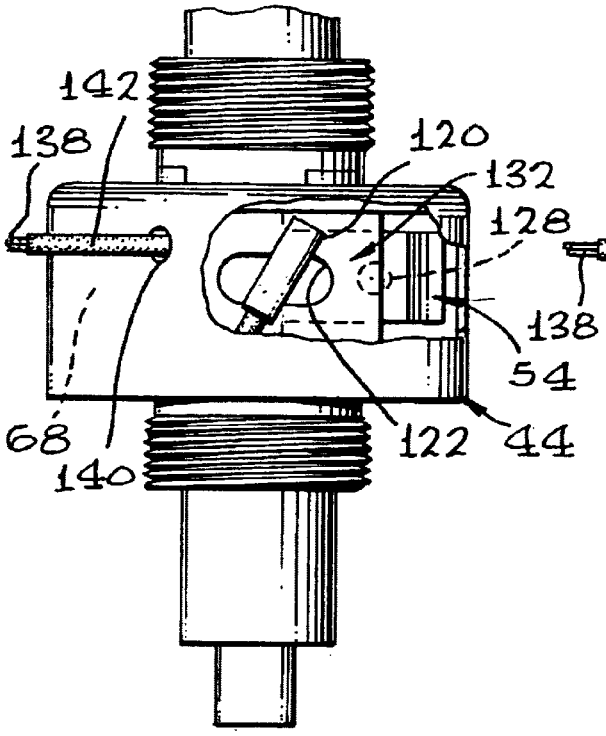
FIG. 7(*a*) is a top view of the lock with sensor as shown in FIG. 6, partially in section, with the lever in the extended position.
Figure 8A:
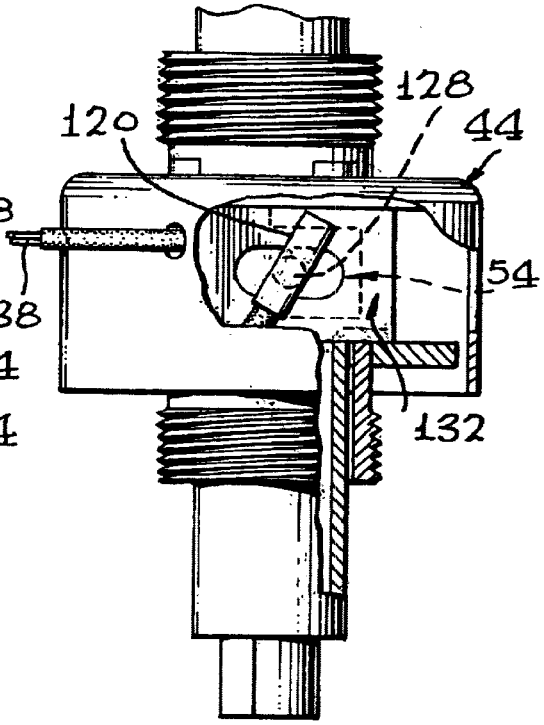
FIG. 8(*a*) is a top view of the lock with sensor as shown in FIG. 6, partially in section, with the lever in the retracted position.
Figure 7B:
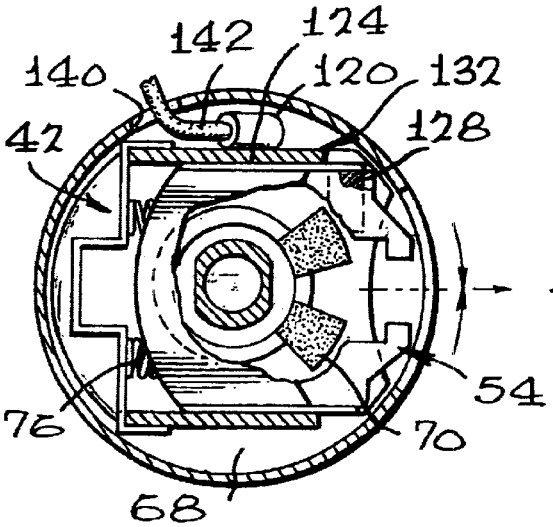
Figure 8B:
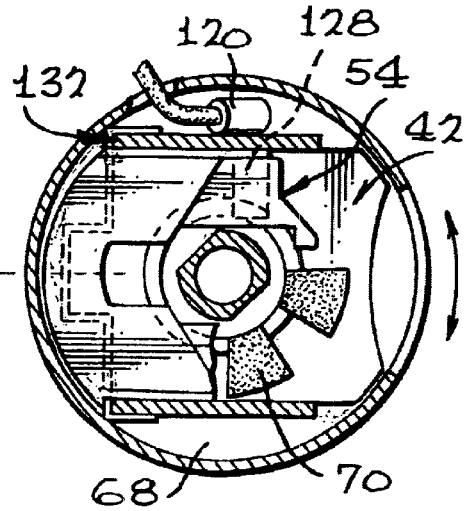

It will be noted that the lock with sensor shown in FIGS. 3 to 5 of the drawings includes a sensing mechanism which uses the opening and closing of an electric circuit by means of a mechanical device, in this case a pin, for activating or deactivating the source component. Reference is now made to FIGS. 6 to 8 of the drawings, which shows another embodiment of the invention.

In FIGS. 6 to 8 of the invention, the basic components of the lock with sensor are the same as that shown with respect to FIGS. 3 to 5, and a detailed description of the lock in FIG. 6 will therefore not be provided. However, like reference numerals have been used in FIGS. 6 to 8 for corresponding components and elements as described with respect to FIGS. 3 to 5.

In FIGS. 6 to 8, an embodiment of the lock with sensor 40 includes a switch 120 within the chamber 68 defined by the housing 44 and housing base 42. The upper internal bracket 56 has located therein an elongated aperture or slot 122 over which the switch 120 is mounted. This can be clearly seen in FIGS. 7(*a*) and 8(*a*) of the drawings. As described with respect to the embodiment of FIG. 3, the switch 120 is mounted on the upper internal bracket 56, over the slot 122, and is fixed relative thereto. The switch 120 does not move when in the housing.

The latch mechanism 54 has an upper surface 124 having a cylindrical hole 126 bored therein. The cylindrical hole 126 is sized and configured so as to receive a cylindrical shaped magnet 128. The magnet 128 is completely received within the cylindrical hole 126 so that its upper end 130 is flush with, or slightly below, the upper surface 124 of the latch retractor 54. The magnet 128 is retained within the cylindrical hole 126 by affixing a cap or lid 132 over the upper surface 124 of the latch mechanism 54. The cap 132 comprises a cover portion 134 and a connecting portion 136. The connecting portion 136 has rails 138, which slidably engage grooves 140 on the latch retractor 54. When the cap 132 is slid onto the upper surface 124 such that the rails 138 engage within the grooves 140, the cover portion 134 overlies the magnet 128 located in the cylindrical hole 126 so that it will not fall out.

As will be appreciated from the description of the 19 construction of the latch retractor 54 with associated magnet 128, movement of the latch retractor between the extended and retracted position results in the concomitant reciprocation of the magnet 128. As best seen in FIGS. 7(*a*) and 8(*a*) of the drawings, the magnet moves linearly, so as to be under the slot 122, and under the switch 120, when in the retracted position, but, when moved into the extended position, the magnet 128 is no longer located under the slot 122, and therefore under the switch 120. The switch 120 is of the type that is activated and deactivated by a magnetic force. The presence of a magnet in close proximity to the switch 120 will close (or open, as the case may be) the electric circuit in the switch 120. When the magnet is moved away from the switch 120, the activation (or deactivation) thereof will occur.

Therefore, the switch 120 will be in a different condition depending upon the location of the magnet 128. As such, the movement of the magnet 128 towards or away from the switch will open or close the switch 120 depending upon its position.

The cap 32 is comprised of material such that it will not interfere with the ability of the magnet 128 to create a magnetic force on the other side of the cap 132. Furthermore, the presence of the slot 122 ensures that there is no significant barrier or obstacle to the magnetic force when the latch mechanism is in the retracted position; however, when the latch mechanism 54 is extended to the extended position, the upper internal bracket 56 will create such an obstacle.

The switch 120 is connected to a wire 138 which leads from the chamber 68 through a wire slot 140 in the housing 44. The wire 138 is thereafter connected to a source component and/or power supply as may be necessary, as described above. The wire 138 in the embodiment shown in FIGS. 6 to 8 is surrounded by, or encased within, Teflon® tubing 142, to provide a protective sheath.

As will be appreciated from the description above, the invention provides a lock with an internally located sensing apparatus, with the sensing apparatus contained within the housing and sensing whether the latch retractor is in the retracted or extended position. The sensing apparatus has electric wires leading out from the housing in order that the lock may be connected to a source component which will react to signals received from the sensing apparatus of the lock to carry out a desired function.

The invention is not limited to the precise details which are described herein. For example, any mechanical element for activating the switch may be provided. Instead of a pin, the latch may have an appropriately located projection or flange which has the same effect. The switch may be located at any convenient place within the chamber of the lock, relative to the latch mechanism, provided that the switch activator on the latch retractor is, of course, correspondingly located.

Further, while a mechanical and magnetic switch activating system has been shown in the embodiments described above, other methods of determining the position of the latch within the housing, and providing a signal to an external source, may be provided. Thus, the sensing mechanism may comprise light beams, fiber optics, pneumatic or mechanical means, any one of which is connected, whether directly or indirectly, to the source component which responds to the position of the latch retractor 54.

What is claimed is:

1. A lock with sensor comprising:

a housing defining a chamber with a longitudinal axis extending therethrough;

a latch mechanism located within the chamber of the housing and being movable relative thereto in a direction angularly located with respect to the longitudinal axis and in a plane generally parallel to the longitudinal axis between a retracted position wherein the latch mechanism is substantially within the housing and an extended position wherein the latch mechanism extends at least partially outside of the housing; and a sensor mechanism having a fixed switch portion located within the chamber and a movable switch activator portion, the switch activator portion being mounted on and movable with the latch mechanism to thereby activate the fixed switch portion in a first position and deactivate the fixed switch portion in a second position spaced linearly from the first position, one of said fixed switch portion or switch activator portion having a magnetic member which couples with a magnetic coupling means in the other of the switch activator portion or fixed switch portion to thereby activate and deactivate the sensor mechanism.

2. A lock with sensor as claimed in claim 1 wherein the housing comprises a housing base and a housing cover defining the chamber, the housing having therein at least one internal bracket, the fixed switch portion being mounted on said internal bracket.

3. A lock with sensor as claimed in claim 2 wherein the internal bracket is fixed to the housing base and comprises upper and lower portions, each of which portions have jaw clamps which engage the housing cover to secure said housing cover to the housing base.

4. A lock with sensor as claimed in claim 1 further comprising a rotatable cylinder in the housing, the rotatable cylinder engaging, upon rotation, the latch mechanism to move the latch mechanism between the extended and retracted positions.

5. A lock with sensor as claimed in claim 1 wherein the switch activator portion comprises a magnetic member located so as to activate a magnetic coupling means on the fixed switch portion in either the extended or retracted position.

6. A lock with sensor as claimed in claim 5 wherein the switch activator portion actuates the sensor when the magnetic member moves linerally past the magnetic coupling means.

7. A lock with sensor as claimed in claim 6 wherein an insulator is located between the fixed switch portion and the housing, and the insulator and fixed switch portion are mounted to an internal bracket within the housing by means of at last one screw.

8. A lock with sensor as claimed in claim 7 wherein the fixed switch portion has extending therefrom at least one wire, said wire passing through the housing, and being connectable to an external component.

9. A lock with sensor as claimed in claim 8 wherein the external component is a device selected from one or more of the group consisting of; audio alarm, camera, lighting fixtures, computer, clock.

10. A lock with sensor as claimed in claim 6 wherein the magnetic member comprises a magnet, and the fixed switch portion is responsive to a magnetic force generated by the magnet to actuate the switch.

11. A lock with sensor as claimed in claim 10 wherein the magnet member is a magnet which is of substantially cylindrical shape, and is located in a cylindrical bore in the latch mechanism.

12. A lock with sensor as claimed in claim 11 further comprising a cap member attachable to the latch mechanism, the cap member holding the magnet within the cylindrical bore and further being comprised of a material selected for the ability of the cap member to not interfere with the magnetic force.

13. A lock with sensor as claimed in claim 10 wherein the fixed switch portion is mounted on an internal bracket within the housing, the switch portion being located over a slot on the internal bracket such that the magnet moves below the internal bracket, the slot being positioned so that the magnet can activate the switch when the slot is directly therebelow.

14. A lock with sensor as claimed in claim 10 further comprising wires extending from the switch portion through the housing and being connectable to an externally located component.

15. A lock with sensor as claimed in claim 14 wherein the wire is surrounded by a protective sheath coating comprised of Teflon®.

16. A lock with sensor as claimed in claim 15 wherein the latch mechanism is movable in a direction transverse to the longitudinal axis between the retracted position and extended position, and the switch activator poriton is movable in the direction transverse to the longitudinal axis.

17. A method of detecting the position of a latch mechanism within a housing of a lock having a longitudinal axis extending therethrough, the latch mechanism being movable in a direction relative to the longitudinal axis of the housing between a retracted position and an extended position, the method comprising:

mounting a switch member at a fixed location with the housing of the lock;

mounting a magnetically operable switch actuator member on the latch mechanism within the housing, wherein the switch actuator member magnetically couples with and activates the switch member in one of the retracted or extended positions when the latch mechanism is shifted linerally with respect to the switch member, and is remote from the switch member in the other of the retracted or extended positions; and transmitting signals from the switch member, according to the position of the latch mechanism, to an external source component remote from the lock.

18. A method as claimed in claim 17 comprising mechanically activating the switch member.

19. A method as claimed in claim 17 comprising linerally moving the switch actuator member past the switch member for magnetically activating the switch member.

20. A lock with sensor comprising:

a housing defining a chamber;

a latch mechanism located within the chamber of the housing and being movable relative thereto between a retracted position wherein the latch mechanism is substantially within the housing and an extended position wherein the latch mechanism extends at least partially outside of the housing; and a sensor mechanism operable with a circuit to identify the position of the latch mechanism and which sensor mechanism has a fixed switch portion located within the chamber and a movable switch activator portion, said fixed switch portion comprising a fixed switch housing and a resilient switch actuating element mounted thereon, said resilient element being deflectable upon engagement with a hard object and being movable between a first rest position where the circuit is opened and a second position where the circuit is closed, the switch activator portion being mounted on and movable with the latch mechanism and thereby deform the resilient element with the resilient element when deflected being caused to engage the fixed switch portion in such manner to close the circuit, whereby movement of the switch activator portion causes deformation of the resilient element to activate the switch portion in one transverse position and deactivate the switch portion in the other transverse position respectively.

21. A lock with sensor comprising;

a housing defining a chamber with a longitudinal axis extending therethrough;

a latch mechanism located within the chamber of the housing and being movable relative thereto along a latch mechanism axis angularly located to the longitudinal axis between a retracted position wherein the latch mechanism is substantially within the housing and an extended position wherein the latch mechanism extends at least partially outside of the housing; and a sensor mechanism having a fixed switch portion located within the chamber and a movable magnetic switch activator portion, the switch activator portion being mounted so as to move on the latch mechanism axis with the latch mechanism and magnetically couple to a magnetically responsive section of the fixed switch portion in a first position in the latch mechanism axis to actuate or deactivate the fixed switch portion and not to magnetically couple to the magnetically responsive section in a second position displaced linerally with respect to the longitudinal axis from the first position on the latch mechanism axis to thereby activate or deactivate the fixed switch portion respectively.

22. A locking device having a sensor to alert and send a warning signal if there is an attempt to actuate the locking device regardless of whether the locking device is in the locked or unlocked condition, said locking device with sensor comprising:

a lock housing having a chamber therein;

a lever extending through said housing, said lever being movable through actuation of handles on ends of said lever and which can allow opening of the locking device;

a latch mechanism located within the chamber of the housing and being movable relative thereto upon actuation of one of said handles and movement of said lever, such that the latch mechanism can move between a retracted position wherein the latch mechanism is substantially within the housing and an extended position wherein the latch mechanism extends at least partially outside of the housing upon movement of said lever; and a sensor mechanism having a fixed switch portion located within the chamber and a movable switch activator portion, the switch activator portion mounted on and movable with the latch mechanism to thereby activate and deactivate the fixed switch portion, said latch mechanism being movable with movement of either of the handles regardless of whether the lock is in a locked or unlocked condition and regardless of whether a door on which locking device is mounted would open so that a warning signal is generated merely by actuation of either one of said handles.

23. A lock with sensor as claimed in claim 21 further characterized in that said lever comprises a rotatable cylinder in the housing, the rotatable cylinder engaging, upon rotation, the latch mechanism to move the latch mechanism between the extended and retracted positions.

24. A lock with sensor as claimed in claim 21 wherein the fixed switch portion has extending therefrom at least one wire, said wire passing through the housing, and being connectable to an external component.

25. A lock with sensor as claimed in claim 21 wherein the external component is a device selected from one or more of the group consisting of; audio alarm, camera, lighting fixtures, computer, clock.

26. A lock with sensor as claimed in claim 21 wherein the switch activator portion comprises a magnet, and the fixed switch portion is responsive to a magnetic force to actuate the switch.

* * * * *